US006583075B1

(12) United States Patent
Dugan

(10) Patent No.: US 6,583,075 B1
(45) Date of Patent: Jun. 24, 2003

(54) DISSOCIABLE MULTICOMPONENT FIBERS CONTAINING A POLYACRYLONITRILE POLYMER COMPONENT

(75) Inventor: Jeffrey S. Dugan, Erwin, TN (US)

(73) Assignee: Fiber Innovation Technology, Inc., Johnson City, TN (US)

( * ) Notice: Subject to any disclaimer, the term of this patent is extended or adjusted under 35 U.S.C. 154(b) by 0 days.

(21) Appl. No.: 09/456,860

(22) Filed: Dec. 8, 1999

(51) Int. Cl.[7] ..... D02G 3/22

(52) U.S. Cl. ..... 442/337; 442/340; 442/361; 442/362; 442/363; 442/364; 428/373; 428/374; 428/397; 428/903

(58) Field of Search ..... 428/397, 903, 428/373, 374; 442/340, 337, 361, 362, 363, 364

(56) References Cited

U.S. PATENT DOCUMENTS

| | | | | |
|---|---|---|---|---|
| 3,639,953 A | | 2/1972 | Kimura et al. | |
| 3,972,759 A | | 8/1976 | Buntin | |
| 3,978,185 A | | 8/1976 | Buntin et al. | |
| 4,008,344 A | | 2/1977 | Okamoto et al. | |
| 4,304,901 A | | 12/1981 | O'Neill et al. | |
| 4,622,259 A | | 11/1986 | McAmish et al. | |
| 4,714,642 A | | 12/1987 | McAliley et al. | |
| 5,051,222 A | | 9/1991 | Marten et al. | |
| 5,057,368 A | | 10/1991 | Largman et al. | |
| 5,069,970 A | | 12/1991 | Largman et al. | |
| 5,108,820 A | | 4/1992 | Kaneko et al. | |
| 5,137,969 A | | 8/1992 | Marten et al. | |
| 5,154,908 A | | 10/1992 | Edie | |
| 5,162,074 A | | 11/1992 | Hills | |
| 5,277,976 A | | 1/1994 | Hogle et al. | |
| 5,281,477 A | * | 1/1994 | Nakatani et al. | 428/367 |
| 5,336,552 A | | 8/1994 | Strack et al. | |
| 5,366,804 A | | 11/1994 | Dugan | |
| 5,382,400 A | | 1/1995 | Pike et al. | |
| 5,424,123 A | * | 6/1995 | Geirhos et al. | 428/357 |
| 5,518,836 A | | 5/1996 | McCullough | |
| 5,602,222 A | | 2/1997 | Smierciak et al. | |
| 5,618,901 A | | 4/1997 | Smierciak et al. | |
| 5,691,054 A | * | 11/1997 | Tennent et al. | 428/359 |
| 5,700,573 A | | 12/1997 | McCullough | |
| 5,726,241 A | | 3/1998 | Maruyama et al. | |
| 5,736,083 A | | 4/1998 | Dugan | |
| 5,763,103 A | | 6/1998 | McCullough | |
| 5,776,607 A | | 7/1998 | McCullough | |
| 5,776,609 A | | 7/1998 | McCullough | |
| 5,821,012 A | | 10/1998 | McCullough | |
| 5,837,626 A | | 11/1998 | McCullough | |
| 5,858,530 A | | 1/1999 | McCullough, Jr. | |
| 5,902,530 A | | 5/1999 | Jorkasky et al. | |
| 5,976,694 A | | 11/1999 | Tsai et al. | |

OTHER PUBLICATIONS

Lawrence E. Ball, and Richard J. Jorkasky II, "BP Chemicals Introduces Amlon, a New Acrylic Fiber Technology", *IFJ*, Chemical Engineering Section, Apr. 1998, pp. 42, 44, 47.

Eric Bobinsky, "Spinning yarns with melting molecules", *Review*, Apr.–Jun. 1998, pp. 29–31.

Jacqueline I. Kroschwitz, "Carbon Fibers", *Concise Encyclopedia of Polymer Science and Engineering*, pp. 105–108, John Wiley & Sons Publishing (New York/Chichester/Weinheim/Brisbane/Singapore/Toronto).

* cited by examiner

*Primary Examiner*—Elizabeth M. Cole
(74) *Attorney, Agent, or Firm*—Alston & Bird LLP

(57) ABSTRACT

Disclosed are melt processable multicomponent fibers in which at least one component includes a polyacrylonitrile polymer and at least one component includes a fugitive polymer. The melt processable multicomponent fibers of the present invention may be separated into microfilaments formed entirely of polyacrylonitrile, suitable for the production of carbon and graphite fibers. The fibers of the present invention may be used in a variety of applications, including composites and filtration media.

58 Claims, 3 Drawing Sheets

DISSOCIABLE MULTICOMPONENT FIBERS CONTAINING A POLYACRYLONITRILE POLYMER COMPONENT

FIELD OF THE INVENTION

The present invention is related to carbon fibers, and in particular, fine denier carbon fibers and to processes for making the same.

BACKGROUND OF THE INVENTION

Carbon fibers consist of strongly bonded basal planes of aromatic rings stacked tightly on top of each other. Carbon fibers may be produced from a variety of precursors. Two of the most important precursors commercially are polyacrylonitrile (PAN) and natural pitch. In general, a series of heat treatments are used to remove the various non-carbon elements contained in the precursors.

Because of their structure, carbon fibers exhibit properties such as high tensile strength or modulus, chemical resistance, flame resistance, and/or low resistivity. As such carbon fibers are widely used in a variety of applications.

For example, carbon fibers are used extensively in composites. Composites are generally defined as synergistic material systems comprised of a combination of two or more constituents differing in form and/or composition which are insoluble in each other. One of the constituents acts as a reinforcement, bearing the loads to which the composite is subjected. A second component is referred to as the matrix, typically a resin, whose function is to transfer the load between the reinforcing elements. An interface is formed between the reinforcement and the matrix constituents, and the adhesion arising at this interface determines the mechanical properties of the composite article as a whole.

Of particular interest are "advanced composites," which are generally defined as products which are reinforced with materials possessing higher specific tensile strength and/or modulus than the materials they replace, or which contain a matrix exhibiting outstanding temperature or chemical resistance. Advanced composites typically consist of continuous filament reinforcement embedded in a high performance matrix material. Carbon fibers are widely used as the reinforcement constituent in advanced composites.

Although having better modulus, pitch based carbon fibers have lower tensile strength than PAN based carbon fibers, and are generally difficult to melt spin and otherwise process. One technique proposed to address this issue involves the use of bicomponent fibers. For example, U.S. Pat. No. 3,639,953, is directed to bicomponent fibers having a pitch component and a protective synthetic organic component. The synthetic organic polymer component is used to impart strength to the pitch during spinning and to protect the pitch component during later processing. The protective component remains adhered to the pitch component during both melt spinning and subsequent heat treatments, thus becoming an integral part of the final fiber. As stated in the '953 patent, the synthetic organic component and pitch component become infusible and insoluble to heat and solvent. Because the synthetic organic component remains fused to the pitch component, the resultant fibers would be expected to have limited use in many applications, including composites, because the synthetic organic component would interfere with the properties of the composite.

Although possessing better melt spinning properties, PAN based carbon fibers, in particular high modulus PAN carbon fibers, lack flexibility. Several methods have been proposed to address this deficiency. For example, U.S. Pat. No. 5,518,836, is directed to a process for reducing the formation of a high degree of order or crystallinity within the precursor fiber using sub-micron particles. Such fibers, however, would exhibit inferior tensile properties in comparison to traditional PAN based carbon fibers. U.S. Pat. No. 5,858,530 is directed to the use of biregional PAN carbon fibers, in which only the outer portion of the fiber is carbonized. These fibers also would be expected to suffer inferior tensile properties.

SUMMARY OF THE INVENTION

The present invention provides dissociable multicomponent fibers having a melt processable polyacrylonitrile polymer residual component and a fugitive polymer component. Advantageously, the multicomponent fiber is produced by melt spinning a melt processable polyacrylonitrile and fugitive polymer. Following melt extrusion, the melt processable polyacrylonitrile may be subjected to various heat treatments, thus converting the polyacrylonitrile into carbon fibers.

The inventors have found that the multicomponent fibers of the invention can be readily dissociable, yet able to survive conventional textile processing intact. Thus the multicomponent fibers can be used to produce carbon microfilaments having desirable physical properties. In this regard, the fugitive polymer component can be extracted out of the multicomponent fiber at any one of several points of the fiber making process to provide fine denier carbon fibers. Advantageously the resultant carbon microfibers have a denier of less than 0.2 and preferably from about 0.005 to about 0.16 denier.

For example, the fugitive component can include water soluble polymers, such as but not limited to, polyvinyl alcohol, polyethylene oxide, polyacrylamide, polylactic acid, water soluble copolyester resins, and copolymers, terpolymers, and mixtures thereof. Other additives, such as basic or ionic compounds, may be added to an aqueous bath to aid in dissolution, as is known in the art. For example, polylactic acid can be soluble in caustic aqueous solutions. Alternatively the fugitive polymer can include a solvent extractable polymer, such as polystyrene. In this embodiment of the invention, the fugitive polymer is typically extracted from the multicomponent fiber using a suitable solvent after melt spinning but before heat treatment to carbonize the PAN component.

Alternatively, the fugitive component can include a polymer which forms a char upon heat treatment such as that generally associated with the carbonization of PAN polymers. The charred residual component can then be extracted or removed from the multicomponent fibers generally using mechanical means, such as impingement by high pressure air or water jets.

The multicomponent fibers can have a variety of configurations, including pie/wedge fibers, segmented round fibers, segmented oval fibers, segmented rectangular fibers, segmented ribbon fibers, segmented multilobal fibers, and islands-in-the-sea fibers. Thus the resultant carbon microfibers (or carbon microfiber precursors) can in turn have a variety of shapes. Further, because the multicomponent fibers can be meltspun, the resultant fine denier carbon fibers can have desirable strength properties. In addition, the fine denier carbon fibers can exhibit improved flexibility, as compared to conventional carbon fibers. Still further, the fine denier carbon fibers of the invention can possess greater surface area than conventional carbon fibers, and thus can provide improved adhesion in composites and other applications. The fine denier carbon fibers of the invention can also exhibit improved tensile strength as compared to conventional carbon fibers with minimal or no sacrifice of other properties. Still further, the fine denier carbon fibers of the invention can exhibit improved heat insulating properties, and thus can be suitable for use at high temperatures.

The multicomponent fibers of the present invention can be formed into a variety of textile structures, such as fabrics. Fabrics of the present invention may generally be formed by weaving, knitting, or nonwoven processes. In this aspect of the invention, the multicomponent fibers can be dissociated to form microfilaments prior to, during or following fabric formation. The resultant fabrics which include fine denier carbon fibers can be economical to produce and further can have superior characteristics, particularly when used in composites or filtration applications.

The carbon microfibers of the present invention may also be formed into other useful articles, such as yarns, prepreg tape, filtration media, and composites. The yams can include the carbon microfibers of the invention solely, or the carbon microfibers may be commingled with other fibers. The present invention also provides processes for making the multicomponent fibers, carbon microfibers, fabrics and other articles.

Further understanding of the invention will be understood with reference to the brief description of the drawings and detailed description which follows herein.

DETAILED DESCRIPTION OF THE INVENTION

The present invention will be described more fully hereinafter in connection with illustrative embodiments of the invention which are given so that the present disclosure will be thorough and complete and will fully convey the scope of the invention to those skilled in the art. However, it is to be understood that this invention may be embodied in many different forms and should not be construed as being limited to the specific embodiments described and illustrated herein. Although specific terms are used in the following description, these terms are merely for purposes of illustration and are not intended to define or limit the scope of the invention. As an additional note, like numbers refer to like elements throughout.

Referring now to FIG. 1, cross sectional views of exemplary multicomponent fibers of the present invention are provided. The multicomponent fibers of the invention, designated generally as 4, include at least two structured polymeric components, a first component 6, comprising a residual polymer, such as melt processable polyacrylonitrile polymer, and a second component 8, comprising a fugitive polymer, such as poly(vinyl) alcohol.

The term "fugitive" component refers to components of multicomponent fibers which can be removed or extracted from the fiber structure after meltspinning at any of several points during the fiber manufacturing process. The term "residual" component refers to components of multicomponent fibers which remain after the fugitive component(s) is removed. The fugitive component can be removed as discussed in more detail below, including by exposing the multicomponent fiber to a solvent which extracts the fugitive component out of the composite fiber, leaving behind microfilaments comprised of the insoluble, residual component. Alternatively the fugitive components can be mechanically removed from the fiber, for example, by treating the multicomponent fiber to alter or change the physical characteristics of the fugitive component so that the fugitive component can be readily removed from the composite fiber structure.

In general, multicomponent fibers are formed of two or more polymeric materials which have been extruded together to provide continuous contiguous polymer segments which extend down the length of the fiber. For purposes of illustration only, the present invention will generally be described in terms of a bicomponent fiber. However, it should be understood that the scope of the present invention is meant to include fibers with two or more components. In addition, the term "fiber" as used herein means both fibers of finite length, such as conventional staple fiber, as well as substantially continuous structures, such as filaments, unless otherwise indicated.

Figure 1A:
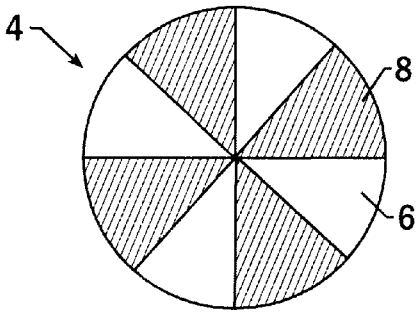
FIGS 1A–1F are cross sectional views of exemplary embodiments of multicomponent fibers in accordance with the present invention.
Figure 1B:
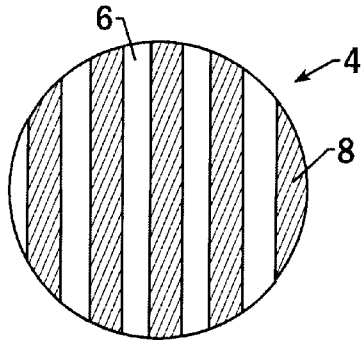
Figure 1C:
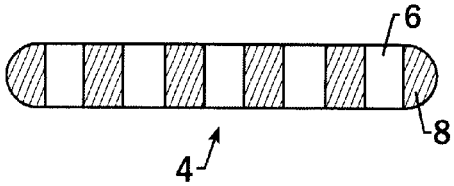
Figure 1D:
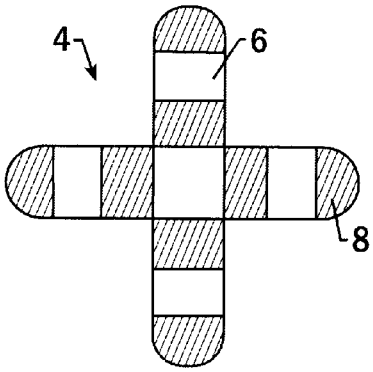
Figure 1E:
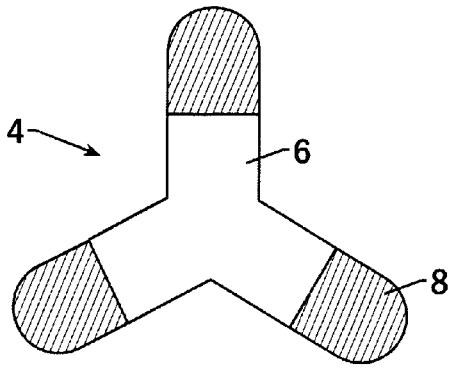
Figure 1F:
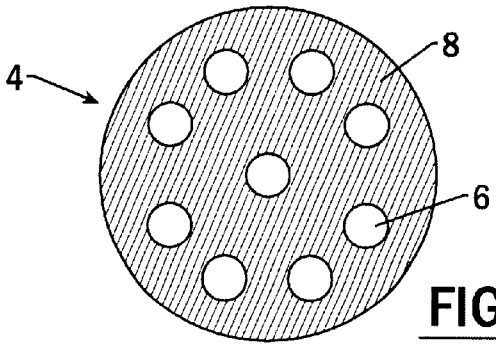

As illustrated in FIGS 1A–1F, a wide variety of fiber configurations that allow the polymer components to be free to dissociate are acceptable. In one advantageous embodiment, the fiber components are arranged so as to form distinct unocclusive cross-sectional segments along the length of the fiber so that none of the components is physically impeded from being extracted. One example of such advantageous embodiment is the pie/wedge arrangement, shown in FIG 1A. The pie/wedge fibers can be hollow or non-hollow fibers. In particular, FIG. 1A provides a bicomponent filament having eight alternating segments of triangular shaped wedges of a residual component 6, such as polyacrylonitrile, and a fugitive polymer component 8. It should be recognized that more than eight or less than eight segments can be produced in filaments made in accordance with the invention. Other fiber configurations as known in the art may be used, such as but not limited to, the segmented round configuration shown in FIG. 1B, commonly referred to as a conjugate fiber. In a further advantageous embodiment, an islands-in-the-sea configuration, such as that shown in FIG. 1F is employed. Reference is made to U.S. Pat. No. 5,108,820 to Kaneko et al., U.S. Pat. No. 5,336,552 to Strack et al., and U.S. Pat. No. 5,382,400 to Pike et al. for a further discussion of multicomponent fiber constructions.

Further, the multicomponent fibers need not be conventional round fibers. Other useful shapes include the segmented ribbon configuration shown in FIG 1C, the segmented cross configuration in FIG 1D, and the multilobal configuration of FIG. 1E. Such unconventional shapes are further described in U.S. Pat. No. 5,277,976 to Hogle et al., and U.S. Pat. Nos. 5,057,368 and 5,069,970 to Largman et al.

Both the shape of the fiber and the configuration of the components therein will depend upon the equipment used in the preparation of the fiber, the process conditions, and the melt viscosities of the two components. A wide variety of fiber configurations are possible. As will be appreciated by the skilled artisan, the fiber configuration is chosen such that the fugitive polymer may be readily removed during the extraction process.

Further, the residual and fugitive polymer components are chosen so as to be mutually incompatible. In particular, the polymer components do not substantially mix together or enter into chemical reactions with each other. Specifically, when spun together to form a composite fiber, the polymer components exhibit a distinct phase boundary between them so that substantially no blend polymers are formed, preventing dissociation. The various components should have the appropriate solubility characteristics, such that the fugitive polymer is soluble in solvent (if extracted using a solvent extraction process), while the insoluble polymer must be capable of withstanding the extraction process without detriment. In addition, a balance of adhesion/incompatibility between the components of the composite fiber is considered highly beneficial. The components advantageously adhere sufficiently to each other to allow the pre-extracted multicomponent fiber to be subjected to conventional textile processing such as winding, twisting, weaving, knitting or carding without any appreciable separation of the components, if so desired. Conversely, the polymers should be sufficiently incompatible so that adhesion between the components is sufficiently weak, so as to provide ready dissolution during the extraction process.

At least one of the residual components subjected to melt spinning includes a melt processable polyacrylonitrile polymer. Following extrusion, the melt processable polyacrylonitrile component may be converted into other residual materials, i.e. carbon or graphite components, by means such as heat treatment. As used herein, the term "polyacrylonitrile polymer" includes polymers comprising at least about 85% by weight acrylonitrile units (generally known in the art as acrylic or polyacrylonitrile polymers). The term "polyacrylonitrile polymer" as used herein also includes polymers which have less that 85% by weight acrylonitrile units. Such polymers include modacrylic polymers, generally defined as polymers comprising 35–85% by weight acrylonitrile units and typically copolymerized with vinyl chloride or vinylidene chloride. Preferably, the polyacrylonitrile polymer has at least 85% by weight polyacrylonitrile units. Other polymers known in the art to be suitable precursors for carbon and graphite fibers, such as polyvinyl alcohol, aromatic polyamides, or poly(acetylenes), may be suitable for use in the present invention, if capable of extrusion by melt spinning.

Exemplary melt processable polyacrylonitriles are described in U.S. Pat. Nos. 5,602,222 and 5,618,901 the entire disclosure of each of which is hereby incorporated by reference. See also U.S. Pat. No. 5,902,530, the entire disclosure of which is also incorporated herein by reference. Such polymers are commercially available, for example, from BP Chemicals as the "Amlon™" acrylic polymers, "Barex®" acrylic polymers, and the like. See *International Fiber Journal*, p. 42, April 1998, hereby incorporated by reference in its entirety.

Melt processable polyacrylonitrile is particularly attractive for use in the present invention because it is an excellent precursor for the formation of carbon fibers. In addition, melt processable polyacrylonitrile exhibits adequate heat resistance, with a melting point of approximately 185° C. Polyacrylonitrile fibers also exhibit good tensile strength and resilience. In addition, polyacrylonitrile fibers are especially advantageous in those embodiments employing dissolution as a means of extraction, because polyacrylonitrile possesses superior water and chemical resistance, thus allowing a wide range of solvents to be employed in the dissolution of the fugitive component.

In addition to containing acrylonitrile monomer, melt processable polyacrylonitrile polymers can also include olefinically unsaturated monomer. The acrylonitrile olefinically unsaturated polymer is preferably made up of about 50 weight % to about 95 weight %, preferably about 75 weight % to about 93 weight %, and most preferably about 85 weight % to about 92 weight %, of polymerized acrylonitrile monomer, and at least one of about 5 weight % to about 50 weight %, preferably about 7 weight % to about 25 weight %, and most preferably about 8 weight % to about 15 weight %, of polymerized olefinically unsaturated monomer.

The olefinically unsaturated monomer can include one or more of an olefinically unsaturated monomer with a C=C double bond polymerizable with an acrylonitrile monomer. The olefinically unsaturated monomer can be a single polymerizable monomer resulting in a co-polymer, or a combination of polymerizable monomers resulting in a multipolymer. The choice of olefinically unsaturated monomer or a combination of monomers can depend upon the properties desired to impart to the resulting fiber and its end use. The olefinically unsaturated monomer generally includes, but is not limited to, acrylates such as methyl acrylates and ethyl acrylates; methacrylates, such as methyl methacrylate; acrylamides and methacrylamides and each of their N-substituted alkyl and aryl derivatives, such as acrylamide, methacrylamide, N-methylacrylamide, N, N-dimethyl acrylamide; maleic acid and its derivatives, such as N-phenylmaleimide; vinylesters, such as vinyl acetate; vinylethers, such as ethyl vinyl ether and butyl vinyl ether; vinylamides, such as vinyl pyrrolidone; vinylketones, such as ethyl vinyl ketone and butyl vinyl ketone; styrenes, such as methylstyrene, styrene and indene; halogen containing monomers, such as vinyl chloride, vinyl bromide, and vinylidene chloride; ionic monomers, such as sodium vinylsulfonate, sodium styrenesulfonate, and sodium methyl sulfonate; acid containing monomers such as itaconic acid, styrene sulfonic acid and vinyl sulfonic acid; base-containing monomers, such as vinyl pyridine, 2-aminoethyl-N-acrylamide, 3-aminopropyl-N-acrylamide, 2-aminoethylacrylate, 2-aminoethylmethacrylate; and olefins, such as propylene, ethylene, isobutylene. Other monomers, such as vinyl acetate, acrylic esters, and vinyl pyrrolidone, may also be included in conventional polyacrylonitrile in small amounts, to allow the resulting polyacrylonitrile fiber to be dyed with conventional textile dyes. Additional properties may also be imparted to melt processable polymers containing significant amounts of acrylonitrile by choosing appropriate co-monomers or blends thereof. For example, the inclusion of styrene in the polymer results in improved heat distortion; isobutylene improves the flexibility; halogen containing monomers increase the flame resistance of the polymer. Still further, the acrylonitrile polymer can include methacrylonitrile monomer. The use of such co-monomers is discussed in more detail in U.S. Pat. Nos. 5,602,222 and 5,618,901.

As noted above, the melt processable polyacrylonitrile component of the present invention is a precursor for the formation of carbon fibers. Carbonaceous fibers are typically divided into two categories: amorphous carbon fibers and graphite fibers. For ease of reference, unless otherwise noted, the term carbon fibers or microfilaments, as used herein, refers to all carbonaceous fibers in the general sense, and includes graphite fibers as well as amorphous carbon fibers. Graphite microfilaments are defined herein as fibers which consist essentially of carbon, and in particular greater than 99% carbon, and have a predominant x-ray diffraction pattern characteristic of graphite. Amorphous carbon microfilaments, on the other hand, are defined as fibers in which the bulk of the fiber weight, in particular between about 70 to about 99%, can be attributed to elemental carbon, and which exhibits an essentially amorphous x-ray diffraction pattern. Graphite microfilaments generally have a higher Young's modulus than do carbon microfilaments and in addition are more highly electrically conductive. It will be understood, however, that all carbon microfilaments tend to include at least some crystalline graphite.

As will also be appreciated by the skilled artisan, carbon and graphite fibers can be formed by heat treatment of PAN fibers, as described in more detail below. By selecting appropriate heat treatment conditions, such as atmosphere and heating temperatures, the PAN precursor is progressively stabilized (or oxidized), carbonized to form carbon fiber, and ultimately graphitized to form graphite fiber.

At least one other component of the fibers of the invention comprises a fugitive polymer. As noted above, as defined herein, fugitive polymers are fiber forming resins which are removed, or extracted, from the multicomponent fiber, thus providing microfilaments comprised of the residual component. In one advantageous embodiment, the fugitive polymer may be removed from the multicomponent fiber by dissolution prior to heat treatment of the fiber to stabilize (or oxidize) and/or carbonize and/or graphitize the PAN component. In this embodiment of the invention, the fugitive component can include a polymer which can be dissolved using any of a variety of solvents, including water and hydrocarbon solvents. In those aspects which utilize water as a solvent, additives, such as caustic or ionic compounds, may be added to the bath to aid in dissolution. Suitable water soluble polymers include without limitation polyvinyl alcohol, polyethylene oxide, polyacrylamide, water soluble copolyester resins, and copolymers, terpolymers, and mixtures thereof. In one particularly advantageous embodiment, polyvinyl alcohol is employed. In particular, polyvinyl alcohol produced by hydrolysis of polyvinyl acetate to a degree of 70 to 100%, preferably 75 to 95%, may be utilized in the present invention. Suitable polyvinyl alcohols are described for example in U.S. Pat. Nos. 5,137,969 and 5,051,222. The polyvinyl alcohol may contain other additives like plasticizers or other water-soluble polymers like poly(vinyl pyrrolindone), poly(ethyloxazoline) and poly(ethylene oxide). One such example of a plasticized polyvinyl alcohol is Vinex 2019, from Texas Polymer Services. In an alternative advantageous embodiment, water soluble copolyesters are employed, such as those disclosed in U.S. Pat. No. 5,366,804, hereby incorporated by reference. An example of one such advantageous water soluble copolyester is AQ55S from Eastman Chemical Corp. In a further alternative advantageous embodiment, fiber forming polymers such as those described in U.S. Pat. No. 5,976,694, e.g. a blend formed from water soluble copolyester and polylactic acid, may be of use in the present invention.

Suitable hydrocarbon solvent soluble polymers include without limitation polystyrene and copolymers thereof, polystyrene-acrylonitrile copolymers, and polystyrene-methyl methacrylate copolymers, all of which are soluble in either aromatic or chlorinated hydrocarbons. One example of a hydrocarbon soluble polystyrene copolymer is described in U.S. Pat. No. 4,008,344, hereby incorporated by reference. Polyvinyl acetate, which is soluble in acetone, may also be employed in the present invention.

In an alternative embodiment, the multicomponent fiber is treated to stabilize (or oxidize) and/or carbonize and/or graphitize the PAN component prior to removal of the fugitive polymer component. In this embodiment of the invention, the fugitive polymer is selected so that the polymer forms a char when heated, and the char remains of the fugitive polymer may be extracted or removed mechanically. In this regard, due to the extreme heats involved in the carbonization and graphitization processes, conventional fiber forming polymers are oxidatively consumed, thus producing a char. Therefore, any fiber forming polymer producing a fairly weak, i.e. removable, char is suitable for use in this embodiment of the invention. Examples of such suitable fugitive polymers include without limitation polyamide, polyester, polyester ether, polyolefin, polyvinyl chloride, polyvinylidene chloride, polyurethane, and copolymers, terpolymers, and the like and mixtures thereof.

Each of the polymeric components can optionally include other components not adversely effecting the desired properties thereof. Exemplary materials which could be used as additional components would include, without limitation, stabilizers, surfactants, waxes, flow promoters, solid solvents, particulates, and other materials added to enhance processability of the residual and fugitive components. These and other additives can be used in conventional amounts.

The weight ratio of the polyacrylonitrile component and the fugitive component present in the multicomponent filament can vary. Preferably the weight ratio is in the range of about 10:90 to 90:10, more preferably from about 20:80 to about 80:20, and most preferably from about 35:65 to about 65:35.

The dissociable multicomponent fibers of the invention (as well as residual microfilaments of the invention) can be provided as staple fibers, continuous filaments, or meltblown fibers. In general, staple, multi-filament, and spunbond multicomponent fibers formed in accordance with the present invention can have a fineness of about 0.5 to about 100 denier. Meltblown multicomponent filaments can have a fineness of about 0.001 to about 10.0 denier. Monofilament multicomponent fibers can have a fineness of about 50 to about 10,000 denier. Denier, defined as grams per 9000 meters of fiber, is a frequently used expression of fiber diameter. A lower denier indicates a finer fiber and a higher denier indicates a thicker or heavier fiber, as is known in the art.

The dissociation of the components of the multicomponent fibers of the invention provides a plurality of fine denier filaments, or microfilaments, each comprised of the residual polymer component. The residual polymer component may be in the form of either polyacrylonitrile, oxidized (or stabilized) polyacrylonitrile, amorphous carbon or graphite, depending on when the dissociation process is performed. As used herein the terms "fine denier filaments" and "microfilaments" include sub-denier filaments and ultra-fine filaments. Sub-denier filaments typically have deniers in the range of 1 denier per filament or less. Ultra-fine filaments typically have deniers in the range of from about 0.1 to 0.3 denier per filament. Preferably, the microfibers of the invention have an average size of less than 0.2 denier, and more preferably from about 0.005 to 0.16 denier. As discussed previously, fine denier filaments of low orientation have typically been obtained from relatively low molecular weight polymers by meltblowing. The present invention provides much stronger fine denier meltspun polyacrylonitrile, carbon, and graphite filaments than previously available. In addition, the invention provides a method by which continuous fine denier polyacrylonitrile, carbon, and graphite filaments can be produced at commercial throughputs from relatively high molecular weight polymers with acceptable manufacturing yields.

Figure 2A:
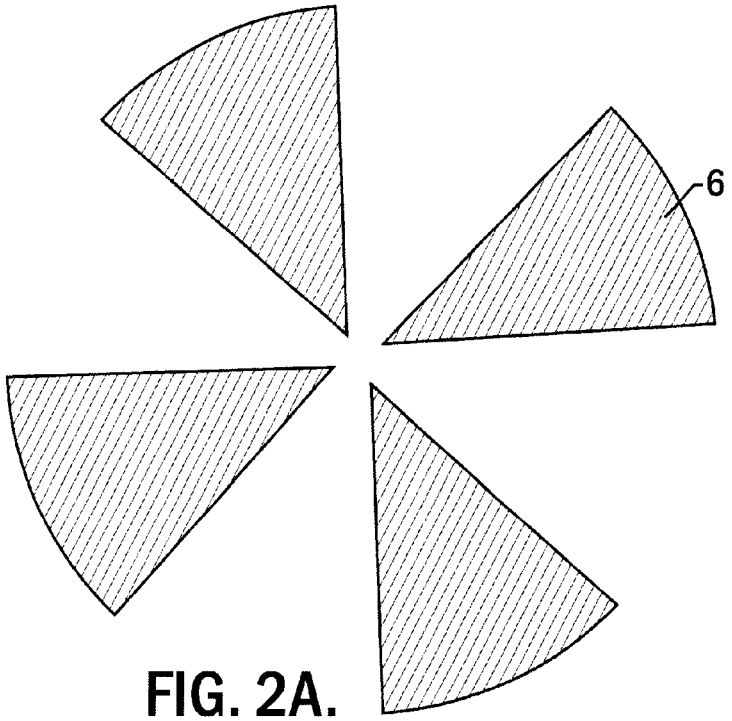
FIGS. 2A and 2B are cross sectional and longitudinal views, respectively, of an exemplary dissociated fiber in accordance with one embodiment of the present invention.
Figure 2B:
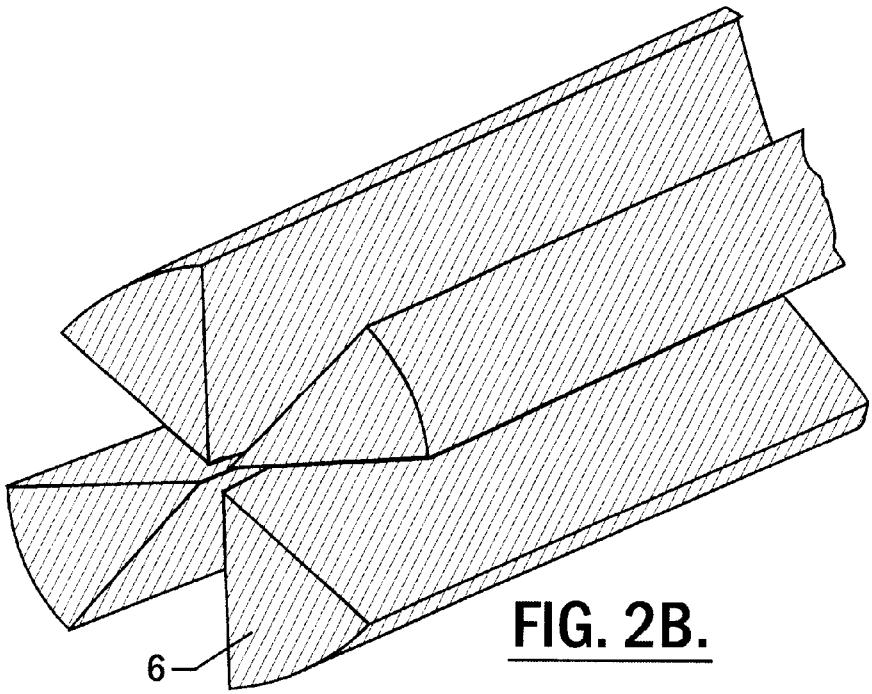

FIG. 2 illustrates an exemplary multicomponent fiber of the present invention which has been separated into a fiber bundle 10 of residual microfilaments as described above. In the illustrated example, the fugitive component has been extracted out of the multicomponent fiber, leaving the residual microfilaments 6, and thus providing a fiber bundle comprised of four microfilaments. In a typical example, residual fiber bundles having 4 to 48, preferably 8 to 24, segments is produced. Although wedge shaped residual microfilaments are illustrated in FIG. 2, other shapes are possible, including multi-lobal, hexagonal, and rectangular shapes.

Generally, the tenacity of the multicomponent fiber ranges from about 1 to about 5, advantageously from about 1.5 to about 3.5 grams/denier (gpd). The tenacity of the polyacrylonitrile microfilaments produced in accordance with the present invention can range from about 1.5 to about 3.5 gpd, and typically from about 2 to about 3. The tenacity for the amorphous carbon microfilaments produced from the polyacrylonitrile precursor can range from about 10 to about 30 gpd, typically from about 16 to about 25 gpd, with a modulus of less than about 380 GPa. For example, carbon microfilaments having at least 92% carbon can have a modulus of at least about 228 Gpa. The graphite microfilaments subsequently produced from the carbon microfilaments are characterized by a modulus which generally exceeds about 380 Gpa. Grams per denier, a unit well known in the art to characterize fiber tensile strength, refers to the force in grams required to break a given filament or fiber bundle divided by that filament or fiber bundle's denier.

The multicomponent fibers of the present invention may be dissociated into the residual microfilaments by any means suitable to extract the fugitive component from the multicomponent fiber. As used herein, the terms "dissociating," or "extracting" mean that the fugitive components is removed at least partially, and preferably completely, from the original multicomponent fiber. Means such as dissolution of the fugitive component or mechanical removal of the fugitive component following charring are particularly advantageous. As illustrated in FIG. 2, the residual components can remain in close proximity following extraction, thus providing a coherent fiber bundle 10 of fine denier residual microfilaments 6, for example fine denier polyacrylonitrile filaments. However, as the skilled artisan will appreciate, in some extraction techniques, such as extraction of fugitive char by means such as impingement with air and the like, the residual microfilaments, i.e. carbon microfilaments, may be further removed from one another.

Figure 3:
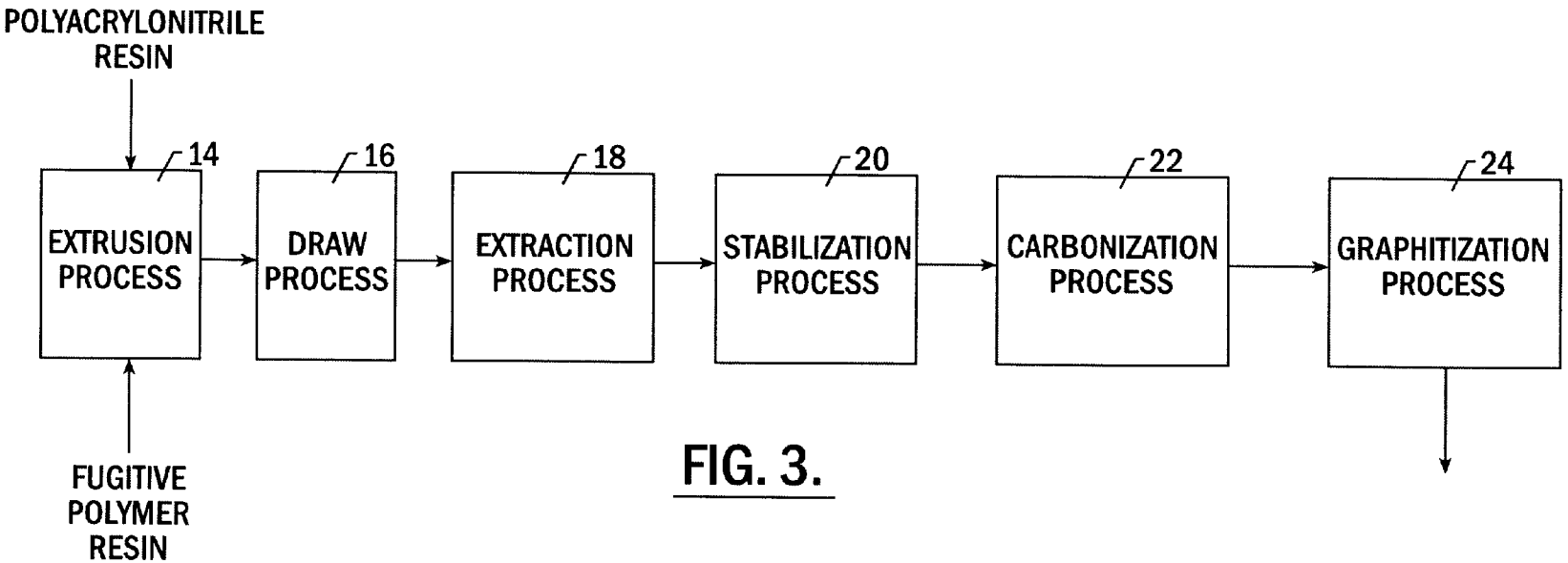
FIG. 3 is a flow diagram illustrating a microfilament formation process according to one embodiment of the present invention.

Turning now to FIG. 3, an exemplary process for producing graphite microfilaments in accordance with one embodiment of the invention is illustrated. Specifically, FIG. 3 illustrates an extrusion process 14, followed by a draw process 16, an extraction process 18, a stabilization process 20, a carbonization process 22, and a graphitization process 24.

The extrusion process 14 for making multicomponent continuous filament fibers is well known and need not be described here in detail. Generally, to form a multicomponent fiber, at least two polymers are extruded separately and fed into a polymer distribution system wherein the polymers are introduced into a spinneret plate. The polymers follow separate paths to the fiber spinneret and are combined in a spinneret hole. The spinneret is configured so that the extrudant has the desired overall fiber cross section (e.g., round, trilobal, etc.). Such a process is described, for example, in Hills U.S. Pat. No. 5,162,074, the contents of which are incorporated herein by reference in their entirety.

In the present invention, a melt processable polyacrylonitrile polymer stream and a fugitive polymer stream are fed into the polymer distribution system. The polymers typically are selected to have melting temperatures such that the polymers can be spun at a polymer throughput that enables the spinning of the components through a common capillary at substantially the same temperature without degrading one of the components.

Following extrusion through the die, the resulting thin fluid strands, or filaments, remain in the molten state for some distance before they are solidified by cooling in a surrounding fluid medium, which may be chilled air blown through the strands. Once solidified, the filaments are taken up on a godet or other take-up surface. In a continuous filament process, the strands are taken up on a godet that draws down the thin fluid streams in proportion to the speed of the take-up godet.

Continuous filament fiber may further be processed into staple fiber. In processing staple fibers, large numbers, e.g., 10,000 to 1,000,000 strands, of continuous filament are gathered together following extrusion to form a tow for use in further processing, as is known in that art. The use of such tows is likewise known in continuous filament applications, as well. A finish solution may optionally be applied, to aid in fiber processing, as is known in the art. Such finish should be chosen so as not to interfere with downstream processes such as extraction and various heat treatments.

Rather than being taken up on a godet, continuous multicomponent fiber may also be melt spun as a direct laid nonwoven web. In a spunbond process, for example, the strands are collected in an air attenuator following extrusion through the die and then directed onto a take-up surface such as a roller or a moving belt to form a spunbond web. As an alternative, direct laid composite fiber webs may be prepared by a meltblown process, in which air is ejected at the surface of a spinneret to simultaneously draw down and cool the thin fluid polymer streams which are subsequently deposited on a take-up surface in the path of cooling air to form a fiber web.

Regardless of the type of melt spinning procedure which is used, typically the thin fluid streams are melt drawn in a molten state, i.e. before solidification occurs, to orient the polymer molecules for good tenacity. Typical melt draw down ratios known in the art may be utilized. The skilled artisan will appreciate that specific melt draw down is not required for meltblowing processes.

When a continuous filament or staple process is employed, it may be desirable to subject the strands to a draw process 16. In the draw process the strands are typically heated past their glass transition point and stretched to several times their original length using conventional drawing equipment, such as, for example, sequential godet rolls operating at differential speeds. Draw ratios of 2.0 to 4.0 times are typical. Optionally, the drawn strands may be heat set, to reduce any latent shrinkage imparted to the fiber during processing, as is further known in the art.

In the advantageous embodiment provided in FIG. 3, the multicomponent fibers are subjected to an extraction process 18 after drawing. The purpose of the extraction process is to separate the fugitive component out of the multicomponent fiber. If the fugitive component has not been rendered insoluble, e.g. as a result of heat treatments such as those applied during the stabilization 20, carbonization 22, and/or graphitization processes 24, the fugitive component may be extracted from the multicomponent fiber by dissolution. Dissolution involves submerging the multicomponent fiber for an adequate amount of time in a solvent capable of dissolving the fugitive component, thus forming a fiber bundle comprised of residual component microfilaments, such as polyacrylonitrile microfilaments. Suitable solvents include water, hydrocarbons, or other nonpolar solvents, depending on the particular fugitive polymer employed, as is known in the art. In one advantageous example, water soluble copolyester is employed as the fugitive component, and the extraction process consists of immersing the multicomponent fiber in a water bath at a temperature of from about 10° C. to about 100° C., preferably from about 50° C. to about 90° C., for a time period of from about 1 to 180 seconds, whereby the fugitive polymer component is dissolved out of the multicomponent fiber. In an alternative embodiment, polystyrene is employed as the fugitive polymer, and the dissolution bath is comprised of a hydrocarbon solvent, such as acetone. In further alternative embodiments, the fugitive polymer is removed after, rather than prior to, such heat treatment. In these embodiments of the invention, the fugitive polymer forms a insoluble char during heat treatment, and is removed by physical means such as impingement with water jets and the like.

Returning again to FIG. 3, after extraction of the fugitive polymer, the residual microfilaments exiting the extraction process are subjected to a series of heat treatments which convert the polyacrylonitrile microfilaments initially into oxidized polyacrylonitrile microfilaments, then into amorphous carbon microfilaments, and lastly into graphite microfilaments. Although the embodiment illustrated in FIG. 3 depicts the production of graphite fibers, the intermediate products, namely oxidized polyacrylonitrile and amorphous carbon microfilaments, are also within the scope of the present invention and are suitable for use in a wide range of applications, as well. Also, prior to subjecting the residual microfilaments to heat treatment, a sizing may be applied, such as described in U.S. Pat. No. 5,726,241, to minimize filamentary sticking, a problem typically encountered in the production of carbon and graphite fibers.

As noted above, the polyacrylonitrile microfilaments exiting the extraction process 18 are first subjected to a stabilization process 20, which oxidizes, i.e. crosslinks, the precursor fiber, and thus stabilizes the fiber shape. The stabilization process 20 is generally performed by subjecting the residual microfilaments to a temperature of between about 200° C. to 400° C. for a period of time sufficient to oxidize the polyacrylonitrile microfilaments, such as for period of about 1.5 hours. The oxidation is typically carried out in an oxygen containing atmosphere, such as an air environment. Such oxidized polyacrylonitrile is known in the art to be fireproof, and is suitable for use in this form in a variety of applications.

Following the stabilization process, the precursor fiber may then be subjected to a carbonization process 22 for a sufficient amount of time to drive off a significant amount of the non-carbon elements present in the precursor, thereby producing amorphous carbon microfilaments. Carbonization is generally performed at a temperature ranging from about 600° C. up to 2000° C. under a non-oxidizing atmosphere, such as nitrogen, as is known in the art. Following carbonization, the amorphous carbon microfilaments which are produced are suitable for use in a wide range of applications, such as composites, filtration media, and the like. However, if a higher modulus carbonaceous product is desired, the amorphous carbon microfilaments may be subjected to a graphitization process 24. In particular, the amorphous carbon microfilaments may subjected to a heat treatment in excess of 2500° C. in a non-oxidizing atmosphere for a time sufficient to form graphite microfilaments.

Following heat treatment, the fibers of the invention are suitable for use in a wide variety of applications. The carbon fibers may also be subjected to various surface treatments to promote adhesion between the carbon microfilament and a matrix resin, as is known in the art. Further, a protective size, such as epoxy, may be applied to the carbon fiber microfilaments to protect the fibers during downstream processing and provide enhanced adhesion. The fibers may be used in either in the form of a continuous filament, or may be chopped into smaller lengths, such as staple.

Yarns prepared for use in forming woven and knit fabrics are included within the scope of the present invention, as are threads. Such yarns may be prepared from continuous filaments or spun yarns comprising staple fibers of the present invention by methods known in the art, such as twisting or air entanglement. Yarns may be prepared from any of the residual microfilaments of the present invention, including polyacrylonitrile microfilaments, oxidized polyacrylonitrile microfilaments, and carbon microfilaments. Yarns of the present invention may further be commingled with other fiber forming thermoplastic filaments, including high performance thermoplastic filaments such as poly(ether) ether ketone, poly(phenylene) sulfide, and liquid crystalline polymers.

Fabrics, whether prepared from multicomponent fibers prior to extracting the fugitive polymer, from residual microfilament fiber bundles after extraction or yarns formed of the multicomponent fibers and/or residual microfilaments, are included within the scope of the invention, as well. Such fabrics may be formed by any technique known in the art, including knitting, weaving, and non-woven methods. In one particularly advantageous embodiment, fabric is prepared from carbon microfilaments. In an alternative embodiment, fabric formed from either the multicomponent fibers or the oxidized polyacrylonitrile microfilaments is subjected to a series of heat treatments such as those illustrated in FIG. 3.

Nonwoven fabrics may be formed in accordance with the instant invention by any conventional means, including direct-laid means. In one embodiment of such a direct laid fabric, continuous filament multicomponent fiber is spun directly into nonwoven webs by a spunbonding process. In an alternative embodiment of direct laid fabric, multicomponent fibers of the invention are incorporated into a meltblown fabric. The techniques of spunbonding and meltblowing are known in the art and are discussed in various pat.s, e.g., Buntin et al., U.S. Pat. No. 3,987,185; Buntin, U.S. Pat. No. 3,972,759; and McAmish et al., U.S. Pat. No. 4,622,259. Following the formation of such direct laid fabrics, the fugitive polymer component is removed, and the resulting polyacrylonitrile microfilaments comprising the direct laid fabric is subjected to one or more of the heat treatments described above.

The fabrics of the present invention provide a combination of desirable properties of conventional fine denier fabrics and highly oriented fiber fabrics. These properties include fabric uniformity, uniform fiber coverage and high fiber surface area. The fabrics of the present invention also exhibit highly desirable tensile properties. In particular, fabrics formed from the carbon fibers of the present invention are characterized by high tensile strength, high modulus, and heat resistance. In addition, the fibers and fabrics of the present invention possess chemical resistance, and are thus suitable for a wide range of filtration applications. Further, the carbon and graphite microfilaments of the present invention would be suitable for use in insulation, particularly insulation for high temperature applications.

Beneficial products can be produced with the fibers and fabrics of the present invention, as well. In particular, the microfilament fibers and fabrics of the present invention are particularly beneficial for use in composites. Such composites are generally comprised of the carbon fibers of the present invention, i.e. the reinforcement, encased in any of a wide variety of matrix resins. The fibers may be in any of a number of forms. In particular, continuous filament or staple carbon fiber may be supplied to the composite fabricator as a tow or fabric, which the manufacturer combines with a matrix resin, or as large continuous filament or staple tows which have been preimpregnated with a matrix resin, called prepreg tape. These composites may be formed by any means known in the art, including but not limited to open mould methods, such as hand lay-up, spray-up, vacuum bag, filament winding, and centrifugal casting, and closed mould methods, such as hot press molding, compression molding, injection molding, transfer molding, pultrusion, cold press molding, resin injection, and reinforced reaction injection molding. Resins suitable for use as composite matrices include polyolefins, polyesters, polyamides, polyimides, polyamidimides, polyetherimides, polysulfones, polyether ether ketones, poly(phenylene) sulfides, epoxy, and liquid crystalline polymers.

As described above, the synergy inherent in composites is based on the combined advantages of two dissimilar materials, the reinforcement fiber and the matrix resin. Strong adhesion is highly beneficial in composite applications, to ensure an optimum transfer of stresses between the reinforcement and the matrix material. Therefore, reinforcement material possessing a high surface area is extremely advantageous in composite applications, because higher surface areas allow for greater contact between the reinforcement and the matrix, thus yielding increased adhesion between the two components. The present invention maximizes the surface area available for contact within the composite by providing reinforcement in the form of microfibers, which inherently posses high surface area to volume ratios.

The present invention will be further illustrated by the following non-limiting example.

EXAMPLE 1

Continuous multifilament melt spun fiber is produced using a bicomponent extrusion system. A sixteen segment pie/wedge bicomponent fiber is produced having eight segments of a polyacrylonitrile (PAN) polymer and eight segments of water soluble copolyester (co-PET) polymer. The weight ratio of PAN to co-PET in the bicomponent fibers is 70/30. The PAN employed is commercially available as Amlon Resin from BP-Amoco Chemical Corp, supplied at a rate of 210 g/min. The co-PET is AQ55S from Eastman Chemical Corp., supplied at a rate of 90 g/min. The molten filaments are solidified by cooling as they pass through a quench chamber with air flowing at a rate of 1500 cubic feet per minute across the filaments. The fiber passes over a metered finish roll applicator applying a finish of Texafil 2761 (available from Boehme Filatex), and is taken up on a standard fiber package at the rate of 1200 m/min.

Following extrusion, the filaments are subsequently drawn three times, thereby yielding a 3 denier multifilament multicomponent fiber. The co-PET is then extracted from the drawn filaments by submerging the multicomponent filament in a water bath at 85° C. for 2 minutes. Following extraction, the residual PAN microfilaments are suitable for conversion into carbon fibers by any means known in the art.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A carbon microfilament comprising at least about 70% elemental carbon, and having an average size less than 0.2 denier, wherein said microfilament has a cross sectional shape selected from the group consisting of wedge, multi-lobal, hexagonal, and rectangular.

2. The microfilament of claim 1, wherein said microfilament average size ranges from about 0.005 to 0.16 denier.

3. The microfilament of claim 1, wherein said microfilament comprises from about 70% to about 99% elemental carbon.

4. The microfilament of claim 3, wherein said microfilament has a tenacity ranging from about 10 to about 30 gpd and a modulus less than about 380 GPa.

5. The microfilament of claim 1, wherein said microfilament comprises greater than about 99% elemental carbon.

6. The microfilament of claim 5, wherein said microfilament has a modulus of greater than about 380 GPa.

7. The microfilament of claim 1, wherein said microfilament is a continuous filament.

8. The microfilament of claim 1, wherein said microfilament has a cross sectional shape selected from the group consisting of wedge, hexagonal, and rectangular.

9. The microfilament of claim 1, wherein said microfilament has a multi-lobal cross sectional shape.

10. A stabilized microfilament comprising oxidized polyacrylonitrile, said microfilament having an average size less than 0.2 denier, wherein said microfilament has a cross sectional shape selected from the group consisting of wedge, multi-lobal, hexagonal, and rectangular.

11. The microfilament of claim 10, wherein said microfilament is a continuous filament.

12. The microfilament of claim 10, wherein said microfilament has a cross sectional shape selected from the group consisting of wedge, hexagonal, and rectangular.

13. The microfilament of claim 10, wherein said microfilament has a multi-lobal cross sectional shape.

14. A yarn comprising a plurality of residual microfilaments having an average size less than 0.2 denier selected from the group consisting of oxidized polyacrylonitrile microfilaments and carbon microfilaments, wherein said microfilament has a cross sectional shape selected from the group consisting of wedge, multi-lobal, hexagonal, and rectangular.

15. The yarn of claim 14, wherein said yarn comprises a plurality of fiber forming thermoplastic filaments commingled with said residual microfilaments.

16. The yarn of claim 15, wherein said thermoplastic filaments are high performance thermoplastic filaments.

17. The yarn of claim 16, wherein said high performance thermoplastic filaments are selected from the group consisting of poly(ether) ketone, poly(phenylene) sulfide, and liquid crystalline polymers.

18. A fiber bundle comprising a plurality of microfilaments having an average size less than 0.2 denier selected from the group consisting of stabilized polyacrylonitrile microfilaments and carbon microfilaments, wherein said microfilament has a cross sectional shape selected from the group consisting of wedge, multi-lobal, hexagonal and rectangular.

19. The fiber bundle of claim 18, further comprising an epoxy sizing.

20. The yarn of claim 14, wherein said microfilament has a cross sectional shape selected from the group consisting of wedge, hexagonal, and rectangular.

21. The yarn of claim 14, wherein said microfilament has a multi-lobal cross sectional shape.

22. A fabric comprising microfilaments having an average size less than 0.2 denier selected from the group consisting of oxidized polyacrylonitrile microfilaments and carbon microfilaments, wherein said microfilaments have a cross sectional shape selected from the group consisting of wedge, multi-lobal, hexagonal, and rectangular.

23. The fabric of claim 22, wherein said fabric is selected from the group consisting of woven fabrics, knit fabrics, and nonwoven fabrics.

24. The fabric of claim 22, further comprising resin selected from the group consisting of polyolefins, polyesters, polyamides, polyimides, polyamidimides, polyetherimides, polysulfones, polyether ether ketones, poly(phenylene) sulfides, epoxy and liquid crystalline polymers.

25. The fabric of claim 22, wherein said microfilament has a cross sectional shape selected from the group consisting of wedge, hexagonal, and rectangular.

26. The fabric of claim 22, wherein said microfilament has a multi-lobal cross sectional shape.

27. A pre-preg tape comprising microfilaments selected from the group consisting of oxidized polyacrylonitrile microfilaments and carbon microfilaments, wherein said microfilament has a cross sectional shape selected from the group consisting of wedge, multi-lobal, hexagonal, and rectangular.

28. The pre-preg tape of claim 27, wherein said microfilament has a cross sectional shape selected from the group consisting of wedge, hexagonal, and rectangular.

29. The pre-preg tape of claim 27, wherein said microfilament has a multi-lobal cross sectional shape.

30. A composite article comprising microfilaments selected from the group consisting of oxidized polyacrylonitrile microfilaments and carbon microfilaments, wherein said microfilament has a cross sectional shape selected from the group consisting of wedge, multi-lobal, hexagonal, and rectangular.

31. The composite article of claim 30, wherein said microfilament has a cross sectional shape selected from the group consisting of wedge, hexagonal, and rectangular.

32. The composite article of claim 30, wherein said microfilament has a multi-lobal cross sectional shape.

33. Filtration media comprising microfilaments selected from the group consisting of oxidized polyacrylonitrile microfilaments and carbon microfilaments, wherein said microfilament has a cross sectional shape selected from the group consisting of wedge, multi-lobal, hexagonal, and rectangular.

34. The filtration media of claim 33, wherein said microfilament has a cross sectional shape selected from the group consisting of wedge, hexagonal, and rectangular.

35. The filtration media of claim 33, wherein said microfilament has a multi-lobal cross sectional shape.

36. A multicomponent fiber having dissociable polymer components, comprising:

at least one polymer component comprising a melt processable polyacrylonitrile polymer; and at least one fugitive polymer component which is dissociable from said melt processable polyacrylonitrile polymer component.

37. The multicomponent fiber of claim 36, wherein said fugitive polymer is a water soluble polymer.

38. The multicomponent fiber of claim 37, wherein said water soluble polymer is selected from the group consisting of polyvinyl alcohol, polyethylene oxide, polyacrylamide, water soluble copolyester resins, and copolymers, terpolymers, and blends thereof.

39. The multicomponent fiber of claim 36, wherein said fugitive polymer is a solvent soluble polymer.

40. The multicomponent fiber of claim 39, wherein said solvent soluble polymer is selected from the group consisting of polystyrene, polystyrene-acrylonitrile copolymers, and polystyrene-methyl methacrylate copolymers, polyvinyl acetate, and copolymers, terpolymers, and blends thereof.

41. The multicomponent fiber of claim 36, wherein said fugitive polymer comprises a charrable polymer.

42. The multicomponent fiber of claim 41, wherein said charrable polymer is selected from the group consisting of polyamide, polyester, polyester ether, polyolefin, polyvinyl chloride, polyvinylidene chloride, polyurethane, and copolymers, terpolymers, and mixtures thereof.

43. The multicomponent fiber of claim 41, wherein said melt processable polyacrylonitrile polymer has been beat treated to form carbonized polyacrylonitrile having at least 70% elemental carbon; and wherein said fugitive component comprises charred polymer.

44. The fiber of claim 36, wherein said melt processable polyacrylonitrile polymer is selected from the group consisting of modacrylic and acrylic polymers.

45. The fiber of claim 36, wherein said melt processable polyacrylonitrile polymer comprises at least about 85% by weight acrylonitrile units.

46. The fiber of claim 36, wherein said fiber is an islands-in-the-sea fiber.

47. The fiber of claim 36, wherein said fiber is selected from the group consisting of continuous filaments, staple fibers, and meltblown fibers.

48. The fiber of claim 47, wherein said fiber is a continuous filament.

49. The fiber of claim 36, wherein said melt processable polyacrylonitrile component is present in an amount ranging from about 20 weight percent to about 80 weight percent, based on the total weight of the multicomponent fiber.

50. The multicomponent fiber of claim 36, wherein said fiber is a pie/wedge fiber.

51. The multicomponent fiber of claim 36, wherein said fiber is a segmented round fiber.

52. The multicomponent fiber of claim 36, wherein said fiber is a segmented ribbon fiber.

53. The multicomponent fiber of claim 36, wherein said fiber is a segmented multi-lobal fiber.

54. The multicomponent fiber of claim 36, wherein said fiber is a segmented oval fiber.

55. The multicomponent fiber of claim 36, wherein said fiber is a segmented rectangular fiber.

56. A multicomponent fiber having dissociable polymer components, comprising:

a melt processable polyacrylonitrile polymer component; and a water soluble fugitive polymer component;

wherein the weight ratio of said polyacrylonitrile polymer component to said fugitive polymer component ranges from about 80/20 to about 20/80.

57. The multicomponent fiber of claim 56, wherein said water soluble fugitive polymer component comprises polyester.

58. The multicomponent fiber of claim 56, wherein said multicomponent fiber has an islands-in-the-sea configuration.

* * * * *

UNITED STATES PATENT AND TRADEMARK OFFICE

CERTIFICATE OF CORRECTION

PATENT NO. : 6,583,075 B1
DATED : June 24, 2003
INVENTOR(S) : Dugan

It is certified that error appears in the above-identified patent and that said Letters Patent is hereby corrected as shown below:

Column 16,
Line 19, "beat" should read -- heat --.

Signed and Sealed this

Sixteenth Day of September, 2003

JAMES E. ROGAN
*Director of the United States Patent and Trademark Office*